US009589691B2

(12) United States Patent
Allen et al.

(10) Patent No.: US 9,589,691 B2
(45) Date of Patent: Mar. 7, 2017

(54) METHOD OF PRODUCING ISOTOPES IN A NUCLEAR REACTOR WITH AN IRRADIATION TARGET RETENTION SYSTEM

(71) Applicant: GE-HITACHI NUCLEAR ENERGY AMERICAS LLC, Wilmington, NC (US)

(72) Inventors: Melissa Allen, Wilmington, NC (US); Nicholas R. Gilman, Wilmington, NC (US); Heather Hatton, Wilmington, NC (US); William Earl Russell, II, Wilmington, NC (US)

(73) Assignee: GE-HITACHI NUCLEAR ENERGY AMERICAS LLC, Wilmington, NC (US)

( * ) Notice: Subject to any disclaimer, the term of this patent is extended or adjusted under 35 U.S.C. 154(b) by 960 days.

(21) Appl. No.: 13/942,114

(22) Filed: Jul. 15, 2013

(65) Prior Publication Data

US 2013/0336436 A1 Dec. 19, 2013

Related U.S. Application Data

(62) Division of application No. 12/547,210, filed on Aug. 25, 2009, now Pat. No. 8,488,733.

(51) Int. Cl.
*G21G 1/00* (2006.01)
*G21C 19/20* (2006.01)
(Continued)

(52) U.S. Cl.
CPC ..... *G21G 1/0005* (2013.01); *G21C 19/20* (2013.01); *G21C 19/32* (2013.01); *G21G 1/02* (2013.01); *H05H 6/00* (2013.01)

(58) Field of Classification Search
CPC ..... G21G 1/001; G21G 2001/0036; G21G 2001/0052; G21G 2001/0073; G21G 2001/0094; G21G 1/02
See application file for complete search history.

(56) References Cited

U.S. PATENT DOCUMENTS 3,324,540 A * 6/1967 Lotts ..... B22F 7/002 264/5
3,594,275 A 7/1971 Ransohoff at al.
(Continued)

FOREIGN PATENT DOCUMENTS

CA 2653871 A1 * 8/2009 ..... G21G 1/02
CA 2653871 A1 8/2009
(Continued)

OTHER PUBLICATIONS

Unofficial English Translation of Japanese Office Action and Search Report issued in connection with corresponding JP Application No. 2010-185694 on Sep. 2, 2014.
(Continued)

*Primary Examiner* — Marshall O'Connor
(74) *Attorney, Agent, or Firm* — Harness, Dickey & Pierce, P.L.C.

(57) ABSTRACT

Example embodiments are directed to methods of producing desired isotopes in commercial nuclear reactors using instrumentation tubes conventionally found in nuclear reactor vessels to expose irradiation targets to neutron flux found in the operating nuclear reactor. Example embodiments include assemblies for retention and producing radioisotopes in nuclear reactors and instrumentation tubes thereof. Example embodiments include one or more retention assemblies that contain one or more irradiation targets and are useable with example delivery systems that permit delivery of irradiation targets. Example embodiments may be sized, shaped, fabricated, and otherwise configured to successfully move
(Continued)

through example delivery systems and conventional instrumentation tubes while containing irradiation targets and desired isotopes produced therefrom.

10 Claims, 9 Drawing Sheets

(51) Int. Cl.

| | |
|---|---|
| ***G21C 19/32*** | (2006.01) |
| ***G21G 1/02*** | (2006.01) |
| ***H05H 6/00*** | (2006.01) |

(56) References Cited

U.S. PATENT DOCUMENTS

| | | | |
|---|---|---|---|
| 3,879,612 | A | 4/1975 | Foster et al. |
| 3,940,318 | A | 2/1976 | Arino et al. |
| 3,998,691 | A | 12/1976 | Shikata et al. |
| 4,196,047 | A | 4/1980 | Mitchem et al. |
| 4,284,472 | A | 8/1981 | Pomares et al. |
| 4,462,956 | A | 7/1984 | Boiron et al. |
| 4,475,948 | A | 10/1984 | Cawley et al. |
| 4,493,813 | A | 1/1985 | Loriot et al. |
| 4,500,488 | A | 2/1985 | Groh et al. |
| 4,532,102 | A | 7/1985 | Cawley |
| 4,597,936 | A | 7/1986 | Kaae |
| 4,617,985 | A | 10/1986 | Triggs et al. |
| 4,663,111 | A | 5/1987 | Kim et al. |
| 4,729,903 | A | 3/1988 | McGovern et al. |
| 4,782,231 | A | 11/1988 | Svoboda et al. |
| 4,859,431 | A | 8/1989 | Ehrhardt |
| 5,053,186 | A | 10/1991 | Vanderheyden et al. |
| 5,145,636 | A | 9/1992 | Vanderhevden et al. |
| 5,355,394 | A | 10/1994 | van Geel et al. |
| 5,400,375 | A | 3/1995 | Suzuki et al. |
| 5,513,226 | A | 4/1996 | Baxter et al. |
| 5,596,611 | A | 1/1997 | Ball |
| 5,615,238 | A | 3/1997 | Wiencek et al. |
| 5,633,900 | A | 5/1997 | Hassal |
| 5,682,409 | A | 10/1997 | Caine |
| 5,758,254 | A | 5/1998 | Kawamura et al. |
| 5,867,546 | A | 2/1999 | Hassal |
| 5,871,708 | A | 2/1999 | Park et al. |
| 5,910,971 | A | 6/1999 | Ponomarev-Stepnoy et al. |
| 6,056,929 | A | 5/2000 | Hassal |
| 6,160,862 | A | 12/2000 | Wiencek et al. |
| 6,192,095 | B1 | 2/2001 | Sekine et al. |
| 6,233,299 | B1 | 5/2001 | Wakabayashi |
| 6,456,680 | B1 | 9/2002 | Abalin et al. |
| 6,678,344 | B2 | 1/2004 | O'Leary et al. |
| 6,751,280 | B2 | 6/2004 | Mirzadeh et al. |
| 6,804,319 | B1 | 10/2004 | Mirzadeh et al. |
| 6,895,064 | B2 | 5/2005 | Ritter |
| 6,896,716 | B1 | 5/2005 | Jones, Jr. |
| 7,157,061 | B2 | 1/2007 | Meikrantz et al. |
| 7,235,216 | B2 | 6/2007 | Kiselev et al. |
| 2002/0034275 | A1 | 3/2002 | Abalin et al. |
| 2003/0012325 | A1 | 1/2003 | Kernert et al. |
| 2003/0016775 | A1 | 1/2003 | Jamriska et al. |
| 2003/0103896 | A1 | 6/2003 | Smith |
| 2003/0179844 | A1 | 9/2003 | Filippone |
| 2004/0091421 | A1 | 5/2004 | Aston et al. |
| 2004/0105520 | A1 | 6/2004 | Carter |
| 2004/0196942 | A1 | 10/2004 | Mirzadeh et al. |
| 2004/0196943 | A1 | 10/2004 | Di Caprio |
| 2005/0105666 | A1 | 5/2005 | Mirzadeh et al. |
| 2005/0118098 | A1 | 6/2005 | Vincent et al. |
| 2006/0062342 | A1 | 3/2006 | Gonzalez Lepera et al. |
| 2006/0126774 | A1 | 6/2006 | Kim et al. |
| 2007/0133731 | A1 | 6/2007 | Fawcett et al. |
| 2007/0133734 | A1 | 6/2007 | Fawcett et al. |
| 2007/0297554 | A1 | 12/2007 | Lavie et al. |
| 2008/0031811 | A1 | 2/2008 | Ryu et al. |
| 2008/0076957 | A1 | 3/2008 | Adelman |
| 2009/0213977 | A1* | 8/2009 | Russell, II ..... G21B 1/00 376/170 |

FOREIGN PATENT DOCUMENTS

| | | | |
|---|---|---|---|
| JP | 57080598 | A | 5/1982 |
| JP | 06308281 | A | 11/1994 |
| JP | 20090133854 | A | 6/2009 |
| JP | 20090198500 | A | 9/2009 |

OTHER PUBLICATIONS

Office action issued in connection with ROC/Taiwan Patent Application No. 99128324, Jul. 5, 2013.

Swedish Office Action dated May 11, 2011 issued in connection with corresponding SE Application No. 1050865-3 together with unofficial English translation.

* cited by examiner

METHOD OF PRODUCING ISOTOPES IN A NUCLEAR REACTOR WITH AN IRRADIATION TARGET RETENTION SYSTEM

This application is a divisional of U.S. patent application Ser. No. 12/547,210 filed on Aug. 25, 2009, the contents of which is incorporated by reference in its entirety.

BACKGROUND

Field

Example embodiments generally relate to isotopes and apparatuses and methods for production thereof in nuclear reactors.

Description of Related Art

Radioisotopes have a variety of medical and industrial applications stemming from their ability to emit discreet amounts and types of ionizing radiation and form useful daughter products. For example, radioisotopes are useful in cancer-related therapy, medical imaging and labeling technology, cancer and other disease diagnosis, and medical sterilization.

Radioisotopes having half-lives on the order of days are conventionally produced by bombarding stable parent isotopes in accelerators or low-power research reactors with neutrons on-site at medical or industrial facilities or at nearby production facilities. These radioisotopes are quickly transported due to the relatively quick decay time and the exact amounts of radioisotopes needed in particular applications. Further, on-site production of radioisotopes generally requires cumbersome and expensive irradiation and extraction equipment, which may be cost-, space-, and/or safety-prohibitive at end-use facilities.

Because of difficulties with production and the lifespan of short-term radioisotopes, demand for such radioisotopes may far outweigh supply, particularly for those radioisotopes having significant medical and industrial applications in persistent demand areas, such as cancer treatment.

SUMMARY

Example embodiments are directed to methods of producing desired isotopes in commercial nuclear reactors and associated apparatuses. Example methods may utilize instrumentation tubes conventionally found in nuclear reactor vessels to expose irradiation targets to neutron flux found in the operating nuclear reactor. Short-term radioisotopes may be produced in the irradiation targets due to the flux. These short-term radioisotopes may then be relatively quickly and simply harvested by removing the irradiation targets from the instrumentation tube and reactor containment, without shutting down the reactor or requiring chemical extraction processes. The short-term radioisotopes may then be immediately transported to end-use facilities.

Example embodiments may include assemblies for retention and producing radioisotopes in nuclear reactors and instrumentation tubes thereof. Example embodiments may include one or more retention assemblies that contain one or more irradiation targets. Example embodiments may be useable with example delivery systems that permit delivery of irradiation targets. Example embodiments may be sized, shaped, fabricated, and otherwise configured to successfully move through example delivery systems and conventional instrumentation tubes while containing irradiation targets and desired isotopes produced therefrom.

BRIEF DESCRIPTIONS OF THE DRAWINGS

Example embodiments will become more apparent by describing, in detail, the attached drawings, wherein like elements are represented by like reference numerals, which are given by way of illustration only and thus do not limit the example embodiments herein.

DETAILED DESCRIPTION

Detailed illustrative embodiments of example embodiments are disclosed herein. However, specific structural and functional details disclosed herein are merely representative for purposes of describing example embodiments. The example embodiments may, however, be embodied in many alternate forms and should not be construed as limited to only example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected," "coupled," "mated," "attached," or "fixed" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the language explicitly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially and concurrently or may sometimes be executed in the reverse order, depending upon the functionality/acts involved.

Figure 1:
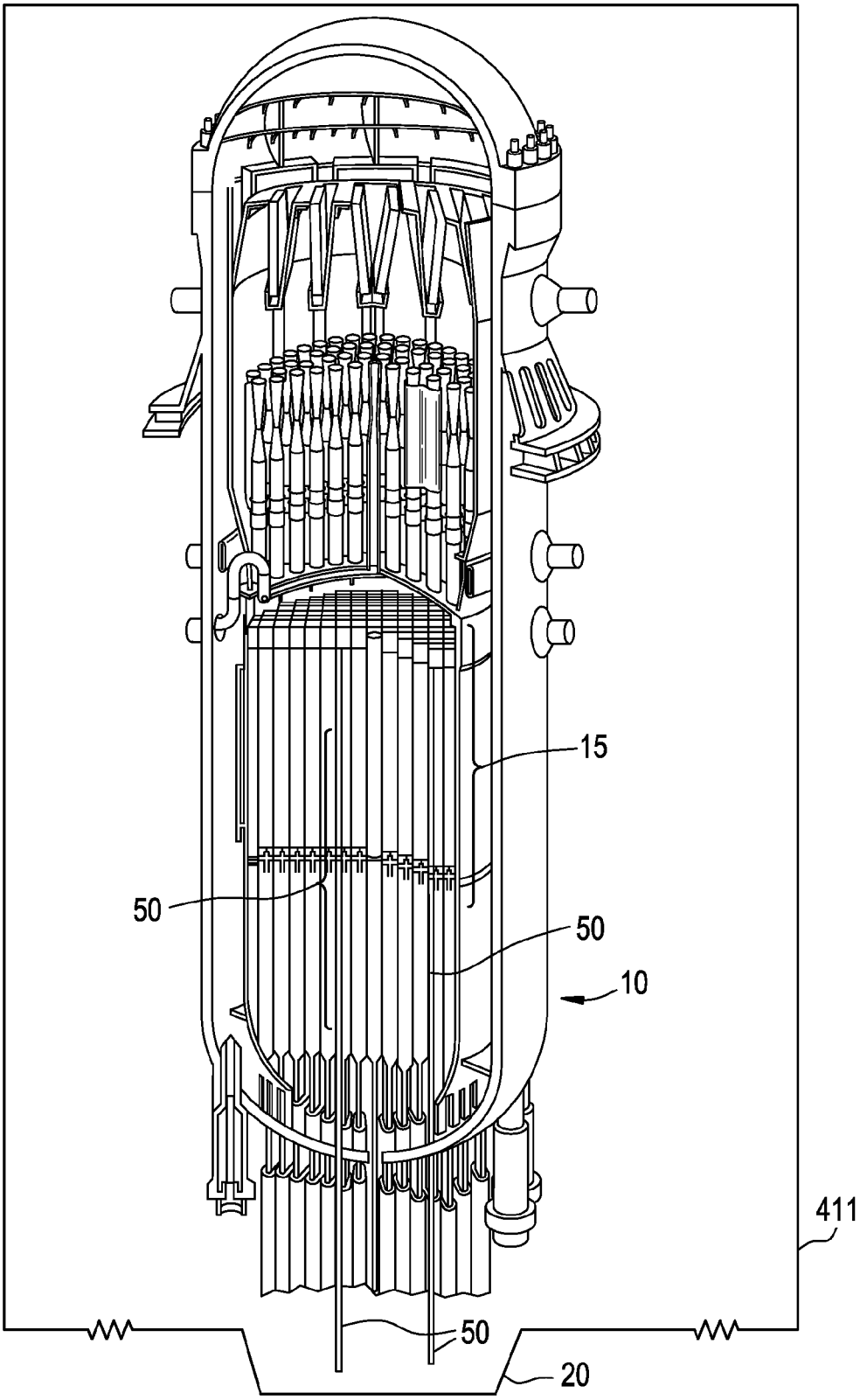
FIG. 1 CONVENTIONAL ART
FIG. 1 is an illustration of a conventional nuclear reactor having an instrumentation tube.

FIG. 1 is an illustration of a conventional reactor pressure vessel 10 usable with example embodiments and example methods. Reactor pressure vessel 10 may be used in at least a 100 MWe commercial light water nuclear reactor conventionally used for electricity generation throughout the world. Reactor pressure vessel 10 may be positioned within a containment structure 411 that serves to contain radioactivity in the case of an accident and prevent access to reactor pressure vessel 10 during operation of the reactor pressure vessel 10. A cavity below the reactor pressure vessel 10, known as a drywell 20, serves to house equipment servicing the vessel such as pumps, drains, instrumentation tubes, and/or control rod drives. As shown in FIG. 1, at least one instrumentation tube 50 extends vertically into the vessel 10 and well into or through core 15 containing nuclear fuel and relatively high amounts of neutron flux during operation of the core 15. Instrumentation tubes 50 may be generally cylindrical and widen with height of the vessel 10; however, other instrumentation tube geometries are commonly encountered in the industry. An instrumentation tube 50 may have an inner diameter and/or clearance of about 0.3 inch, for example.

The instrumentation tubes 50 may terminate below the reactor pressure vessel 10 in the drywell 20. Conventionally, instrumentation tubes 50 may permit neutron detectors, and other types of detectors, to be inserted therein through an opening at a lower end in the drywell 20. These detectors may extend up through instrumentation tubes 50 to monitor conditions in the core 15. Examples of conventional monitor types include wide range detectors (WRNM), source range monitors (SRM), intermediate range monitors (IRM), and/or Local Power Range Monitors (LPRM).

Although vessel 10 is illustrated with components commonly found in a commercial Boiling Water Reactor, example embodiments and methods may be useable with several different types of reactors having instrumentation tubes 50 or other access tubes that extend into the reactor. For example, Pressurized Water Reactors, Heavy-Water Reactors, Graphite-Moderated Reactors, etc. having a power rating from below 100 Megawatts-electric to several Gigawatts-electric and having instrumentation tubes at several different positions from those shown in FIG. 1 may be useable with example embodiments and methods. As such, instrumentation tubes useable in example methods may be any protruding feature at any geometry about the core that allows enclosed access to the flux of the nuclear core of various types of reactors.

Applicants have recognized that instrumentation tubes may be useable to quickly and constantly generate desired isotopes on a large-scale basis without the need for chemical or isotopic separation and/or waiting for reactor shutdown of commercial reactors. Example methods may include inserting irradiation targets into instrumentation tubes and exposing the irradiation targets to the core while operating, thereby exposing the irradiation targets to the neutron flux commonly encountered in the operating core. The core flux may convert a substantial portion of the irradiation targets to a useful radioisotope, including short-term radioisotopes useable in medical applications. Irradiation targets may then be withdrawn from the instrumentation tubes, even during ongoing operation of the core, and removed for medical and/or industrial use.

Example Delivery Systems

Example delivery systems are discussed below in conjunction with example embodiment irradiation target retention assemblies and irradiation targets useable therewith, which are described in detail later. It is understood that example embodiment irradiation target retention assemblies may be useable with other types of delivery systems than those described below.

FIGS. 2-6 are illustrations of related systems for delivering example embodiment irradiation target retention assemblies and irradiation targets into a nuclear reactor, described in co-pending application Ser. No. 12/547,249, filed on the same date herewith, entitled "CABLE DRIVEN ISOTOPE DELIVERY SYSTEM," the contents of which are herein incorporated by reference in their entirety. Example embodiment irradiation target retention assemblies are useable with the related systems described in FIGS. 2-6; however, it is understood that other delivery systems may be used with example embodiment irradiation target retention assemblies.

Figure 2:
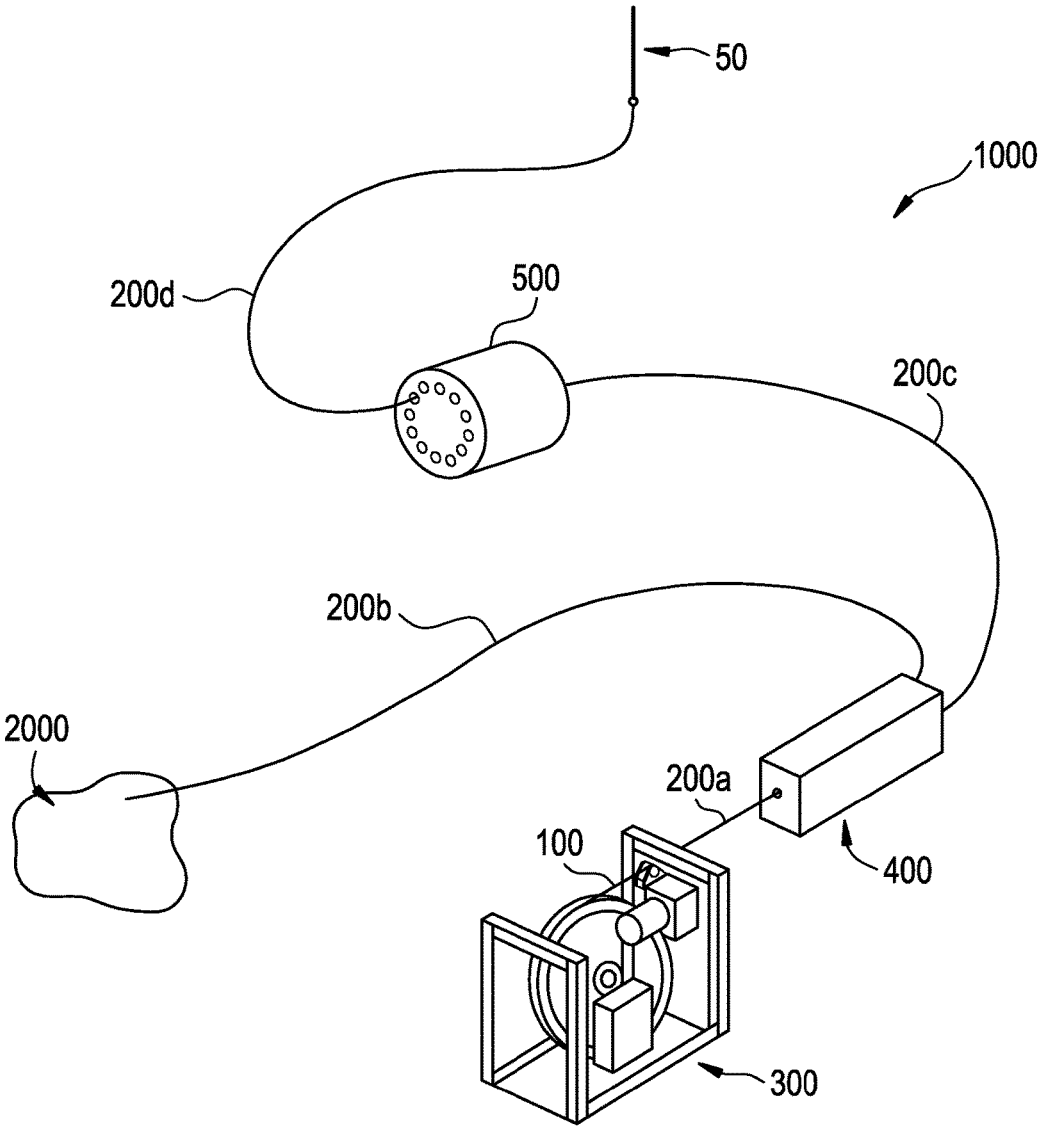
FIG. 2 is an illustration of an example embodiment system for delivering example embodiments into an instrumentation tube of a nuclear reactor.

FIG. 2 illustrates a related cable-driven isotope delivery system 1000 that may use the instrumentation tubes 50 to deliver example embodiment irradiation target retention assemblies into a reactor pressure vessel 10 (FIG. 1). Cable driven isotope delivery system 1000 may be capable of transferring an irradiation target retention assembly from a loading/unloading area 2000, to an instrumentation tube 50 of reactor pressure vessel 10 and/or from instrumentation tube 50 of the reactor pressure vessel 10 to the loading/unloading area 2000. As shown in FIG. 2, cable driven isotope delivery system 1000 may include a cable 100, tubing 200*a*, 200*b*, 200*c*, and 200*d*, a drive mechanism 300, a first guide 400, and/or a second guide 500. The tubing 200*a*, 200*b*, 200*c*, and 200*d* may be sized and configured to allow the cable 100 to slide therein. Accordingly, the tubing 200*a*, 200*b*, 200*c*, and 200*d* may act to guide the cable from one point in the cable driven isotope delivery system 1000 to another point in the cable driven isotope delivery system 1000. For example, tubing 200*a*, 200*b*, 200*c*, and 200*d* may guide cable 100 from a point outside of containment structure 411 (FIG. 1) to a point at instrumentation tube 50 inside containment structure 411.

Figure 3:
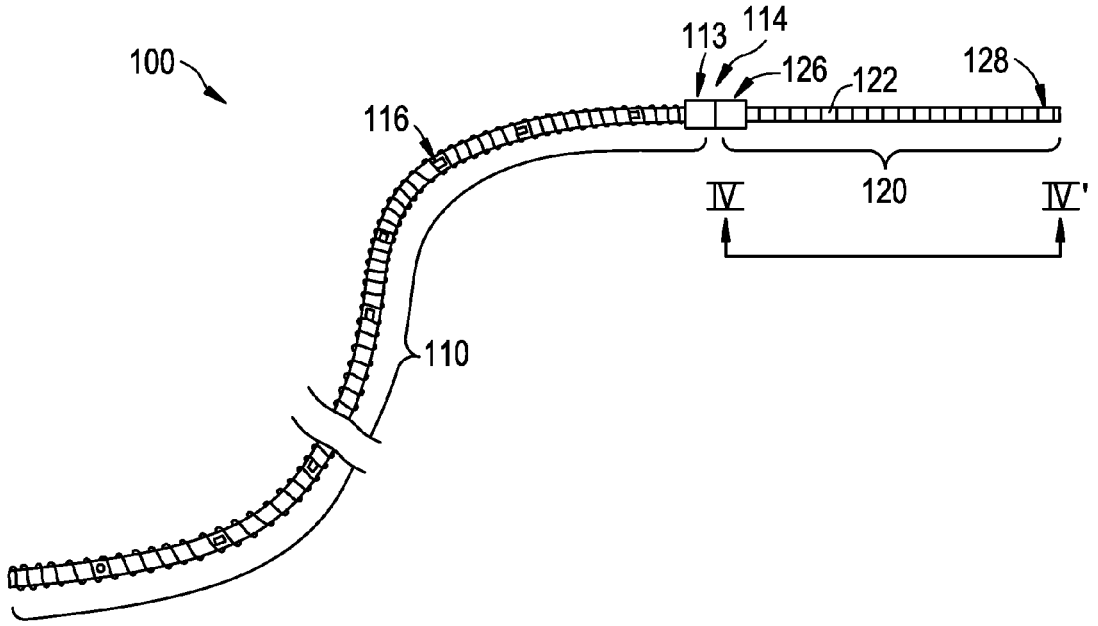
FIG. 3 is a detail view of the example embodiment system of FIG. 2.
Figure 4:
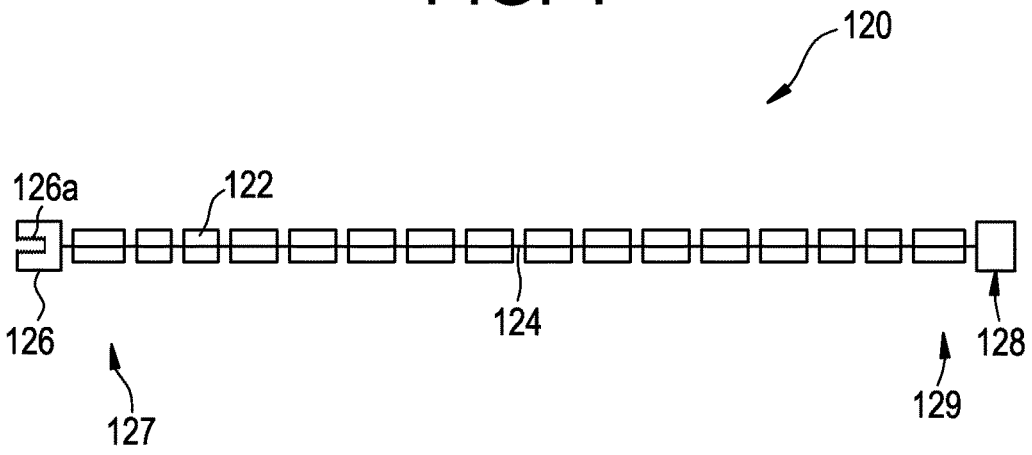
FIG. 4 is a detail view of the example embodiment system of FIG. 3.

An example cable 100 is illustrated in FIGS. 3 and 4. Example cable 100 may have at least two portions: 1) a relatively long driving portion 110; and 2) a target portion 120. Driving portion 110 of cable 100 may be fabricated of a material having a low nuclear cross-section, such as aluminum, silicon, and/or stainless steel. Driving portion 110 of cable 100 may be braided in order to increase the flexibility and/or strength of cable 100 so that cable 100 may be more easily bendable and capable of being wrapped around a reel, for example. Although cable 100 may be easily bendable, cable 100 may additionally be sufficiently stiff in an axial direction so that cable 100 may be pushed through tubing 200*a*, 200*b*, 200*c*, and/or 200*d* without buckling.

As shown in FIG. 4, target portion 120 of example cable 100 may include a plurality of example embodiment irradiation target retention assemblies 122. Target portion 120 may be attached to a first end 114 of the driving portion 110. The length of the target portion 120 may vary depending on a number of factors, including the irradiation target material, the size of the example embodiment irradiation target retention assemblies, the amount of radiation the target is expected to be exposed to, and/or the geometry of the instrumentation tubes 50. As an example, the target portion 120 may be about 12 feet long.

Referring to FIGS. 3-4, target portion 120 may include a first end cap 126 at a first end 127 of target portion 120 and a second end cap 128 at a second end 129 of target portion 120. First end cap 126 may be configured to attach to a first end 114 of driving portion 110. First end cap 126 and first end 114 of driving portion 110 may form a quick connect/disconnect connection. For example, first end cap 126 may include a hollow portion having internal threads 126*a*. First end 114 of driving portion 110 may include a connector 113 having external threads that may be configured to mesh with the internal threads 126*a* of the first end cap 126. Although the example connection illustrated in FIGS. 3 and 4 is described as a threaded connection, one skilled in the art would recognize various other methods of connecting target portion 120 of the cable 100 to driving portion 110 of cable 100.

An operator may configure first guide 400 and second guide 500 so that cable 100 may be advanced to a desired destination. For example, between loading/unloading area 2000 and instrumentation tube 50.

After configuring first and second guides 400 and 500, an operator may operate driving mechanism 300 to advance cable 100 through tubing 200*a*, first guide 400, and second tubing 200*b* to place first end 114 of driving portion 110 of cable 100 into the loading/unloading area 2000. An operator may advance cable 100 by controlling a worm gear in driving mechanism 300 that meshes with cable 100. The location of first end 114 of driving portion 110 of cable 100 may be tracked via markings 116 on cable 100. Alternatively, position of first end 114 of driving portion 110 of cable 100 may be known from information collected from a transducer that may be connected to drive mechanism 300.

After the cable 100 has been positioned in the loading/unloading area 2000 example embodiment retention assemblies 122 may then be connected to cable 100 as described below with reference to example embodiment retention assemblies. An operator may operate driving mechanism 300 to pull the cable from the loading/unloading area 2000 through tubing 200*b* and through first guide 400. The operator may then reconfigure first guide 400 to send cable 100 and example embodiment assemblies 122 to reactor pressure vessel 10. After first guide 400 is reconfigured, the operator may advance cable 100 through third tubing 200*c*, second guide 500, fourth tubing 200*d*, and into a desired instrumentation tube 50. Location of first end 114 of the driving portion 110 of cable 100 may be tracked via markings 116 on cable 100. In the alternative, position of first end 114 of driving portion 110 of cable 100 may be known from information collected from a transducer that may be connected to drive mechanism 300.

After cable 100 bearing example embodiment retention assemblies 122 has been advanced to the appropriate location within instrumentation tube 50, the operator may stop cable 100 in the instrumentation tube 50. At this point, irradiation targets within example embodiment irradiation target retention assemblies may be irradiated for the proper time in the nuclear reactor. After irradiation, the operator may operate driving mechanism 300 to pull cable 100 out of instrumentation tube 50, fourth tubing 200*d*, second guide 500, third tubing 200*c*, and/or first guide 400.

An operator may operate driving mechanism 300 to advance cable 100 through first guide 400, and second tubing 200*b* to place first end 114 of driving portion 110 of the cable 100 and example embodiment irradiation target retention assemblies 122 into the loading/unloading area 2000. Example assemblies 122 may be removed from cable 100 and stored in a transfer cask or another desired location. An example transfer cask may be made of lead, tungsten, and/or depleted uranium in order to adequately shield the irradiated targets. Attachment and detachment of example embodiment retention assemblies 122 may be facilitated by the use of cameras which may be placed in the loading/unloading area 2000 to allow an operator to visually inspect the equipment during operation.

Figure 5:
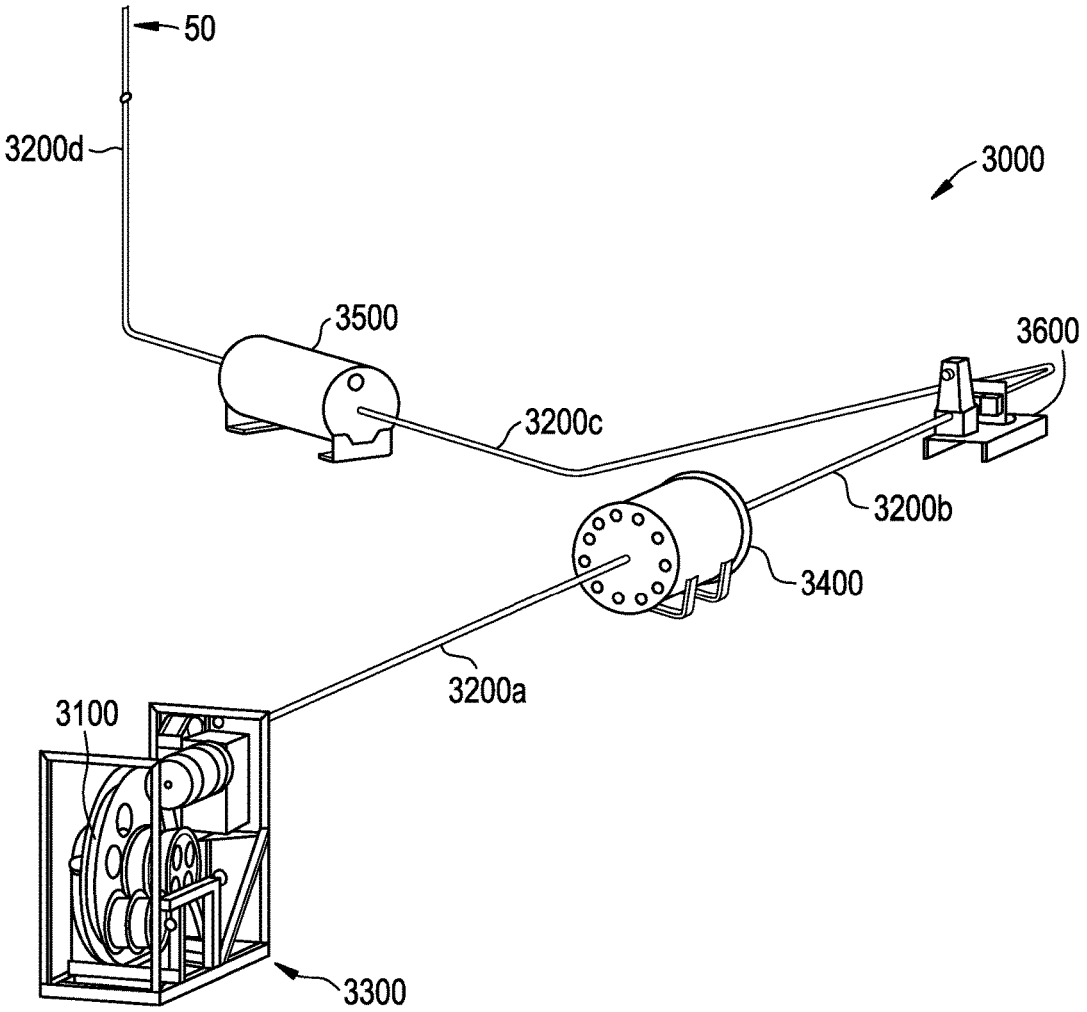
FIG. 5 Conventional Art
FIG. 5 is an illustration of a conventional nuclear reactor TIP system.

An alternate delivery system includes use of a conventional Transverse In-core Probe (TIP) system 3000. A conventional TIP system 3000 is illustrated in FIG. 5. As shown in FIG. 5, TIP system 3000 may include a drive mechanism 3300 for driving a cable 3100, tubing 3200*a* between driving system 3300 and a chamber shield 3400, tubing 3200*b* between chamber shield 3400 and a valve 3600, tubing 3200*c* between valve 3600 and a guide 3500, and tubing 3200*d* between guide 3500 and an instrumentation tube 50. Cable 3100 may be similar to the cable 100 described with reference to FIGS. 2-4. Guide 3500 of conventional TIP system 3000 may guide a TIP sensor to a desired instrumentation tube 50. Chamber shield 3400 may resemble a barrel filled with lead pellets. The chamber shield 3400 may store the TIP sensor when not utilized in the reactor pressure vessel 10. Valves 3600 are a safety feature utilized with TIP system 3000.

Because TIP system 3000 includes a tubing system 3200*a*, 3200*b*, 3200*c*, and 3200*d* and/or a guide 3500 for guiding a cable 3100 into an instrumentation tube 50, these systems may be used as an example delivery mechanism for example embodiment irradiation target retention assemblies and irradiation targets stored therein.

Figure 6:
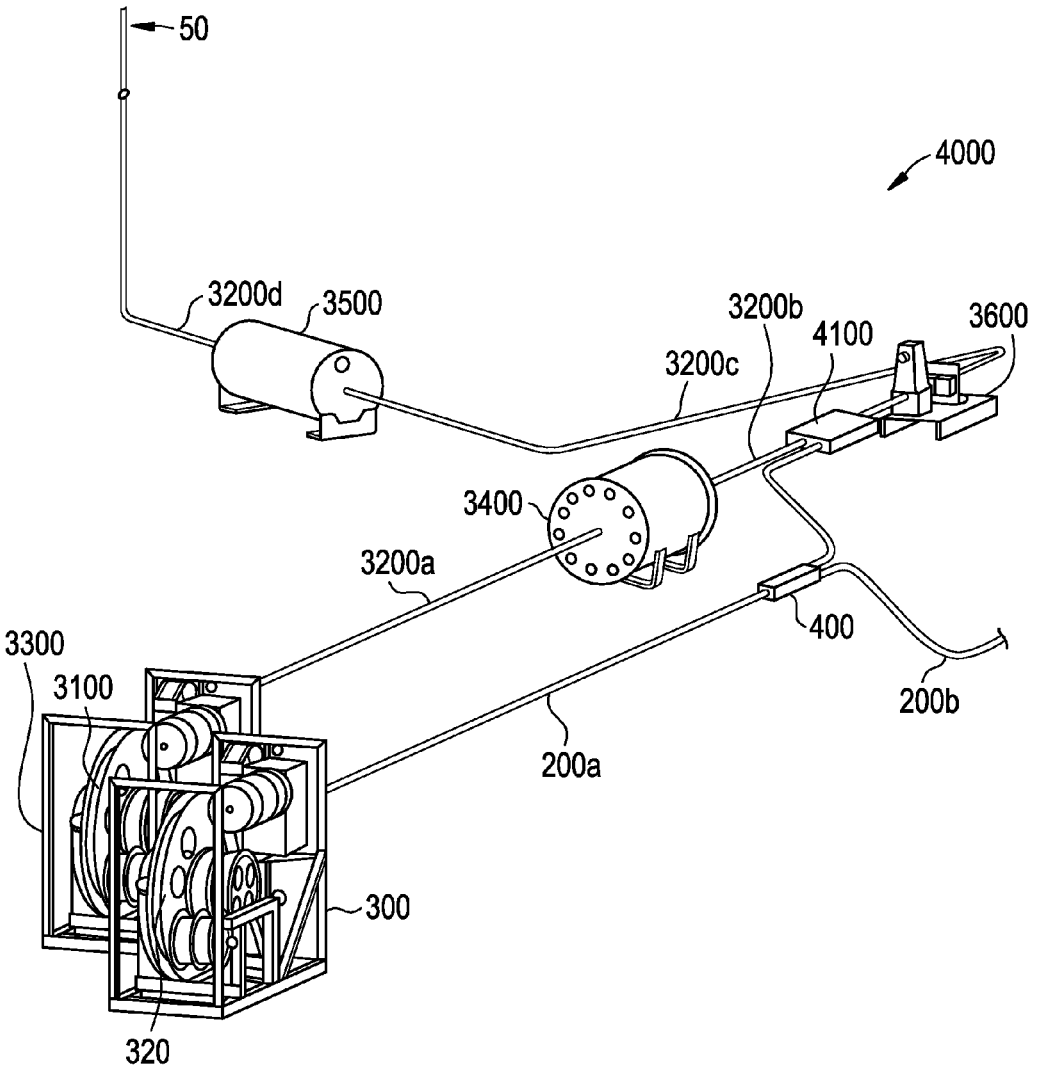
FIG. 6 is an illustration of a further example embodiment system for delivering example embodiments into an instrumentation tube of a nuclear reactor.

FIG. 6 illustrates an example delivery system including a modified TIP system 4000. As shown in FIG. 6, modified TIP system 4000 is similar to conventional TIP system 3000 illustrated in FIG. 5, with a guide 4100 introduced between chamber shield wall 3400 and valves 3600 of conventional TIP system 3000. Guide 4100 may serve as an access point for introducing a cable, for example, cable 100, into modified TIP system 4000. As shown in FIG. 6, drive system 300 (FIG. 2) may be placed in parallel with drive system 3300 of modified TIP system 4000. Drive system 300 may include cable storage reel 320 on which cable 100 may be wrapped. Tube 200*a* may extend from the drive system 3300 to first guide 400 which may direct cable 100 to a desired location. For example, an operator may configure first guide 400 to direct cable 100 to a loading/unloading area 2000 via tubing 200*b* by controlling a rotary cylinder of first guide 400 to align a second end of tubing 200*b* with an appropriate exit point. Rather than having an exit point that may direct cable 100 to second guide 500 (FIG. 2), first guide 400 in modified TIP system 4000 may be configured to direct cable 100 to guide 4100 instead. In this way, first guide 400 may guide cable 100 into the TIP system tubing 3200*a,b,c,d* via guide 4100.

Cable 100 should be sized to function with existing tubing in example delivery systems and permit passage of example embodiment irradiation target retention assemblies. For example, the inner diameter of tubing 3200*a*, 3200*b*, etc. may be approximately 0.27 inches. Accordingly, cable 100 may be sized so that dimensions transverse to the cable 100 do not exceed 0.27 inches.

Example Embodiment Irradiation Target Retention Assemblies

Example delivery systems being described, example embodiment irradiation target retention assemblies useable therewith are now described. It is understood that example retention assemblies may be configured/sized/shaped/etc. to interact with the example delivery systems discussed above, but example retention assemblies may also be used in other delivery systems and methods in order to be irradiated within a nuclear reactor.

Figure 7:
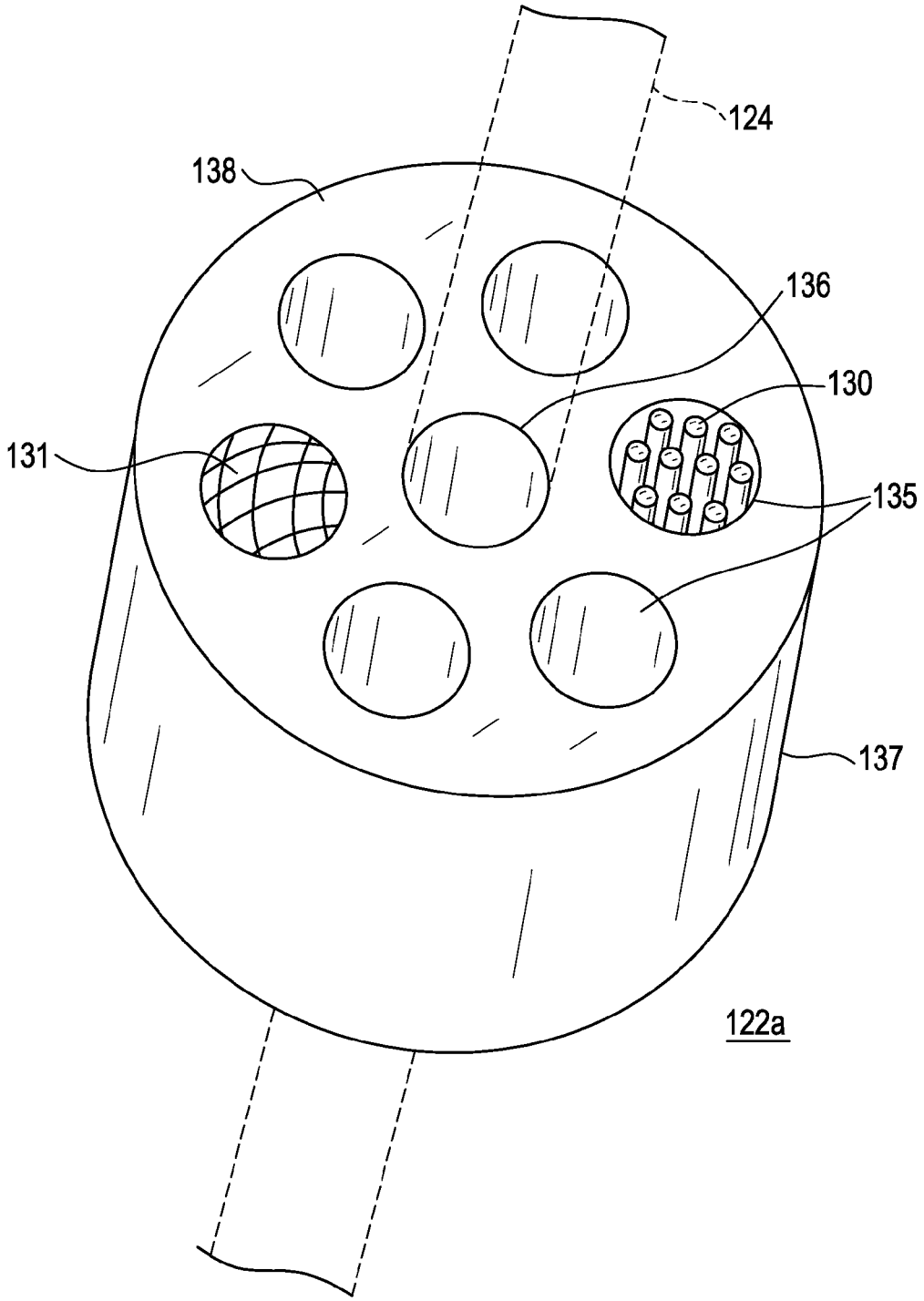
FIG. 7 is an illustration of a first example embodiment irradiation target retention assembly.

FIG. 7 is an illustration of a first example embodiment irradiation target retention assembly 122*a*. As shown in FIG. 7, irradiation target retention assembly 122*a* has dimensions that enable it to be inserted into instrumentation tubes 50 (FIG. 1) used in conventional nuclear reactors and/or through any tubing used in delivery systems. For example, irradiation target retention assembly 122*a* may have a maximum outer diameter 137 of an inch or less. Although irradiation target retention assembly 122*a* is shown as cylindrical, a variety of properly-dimensioned shapes, including hexahedrons, cones, and/or prismatic shapes may be used for irradiation target retention assembly 122*a*.

Example embodiment irradiation target retention assembly 122*a* may include one or more bores 135 that extend partially into assembly 122*a* in an axial direction from a top end/face 138. Alternatively, bores 135 may extend into assembly 122*a* circumferentially or from other positions. Bores 135 may be arranged in any pattern and number, so long as the structural integrity of example embodiment irradiation target retention assemblies is preserved. Bores 135 themselves may have a variety of dimensions and shapes. For example, bores 135 may taper with distance from top face 138 and/or may have rounded bottoms and edges, etc. Example assembly 122*a* may be fabricated of a material that is configured to retain its structural integrity when exposed to flux encountered in an operating nuclear reactor. For example, example assembly 122*a* may be fabricated of zirconium alloy, stainless steel, aluminum, nickel alloy, silicon, graphite, and/or Inconel, etc.

Irradiation targets 130 may be inserted into one or more bores 135 in any desired number and/or pattern. Irradiation targets 130 may be in a variety of shapes and physical forms. For example, irradiation targets 130 may be small filings, rounded pellets, wires, liquids, and/or gasses. Irradiation targets 130 may be dimensioned to fit within bores 135, and/or bores 135 are shaped and dimensioned to contain irradiation targets 130. Additionally, example embodiment irradiation target retention assembly 122*a* may be fabricated from and/or internally contain irradiation target material, so as to become irradiation targets themselves. Irradiation targets 130 may further be sealed containers of a material designed to substantially maintain physical and neutronic properties when exposed to neutron flux within an operating reactor. The containers may contain a solid, liquid, and/or gaseous irradiation target and/or produced radioisotope so as to provide a third layer of containment for irradiation targets 130 within example embodiment retention assembly 122*a*.

A cap 131 may attach to top end/face 138 and seal irradiation targets 130 into bores 135. Cap 131 may attach to top end 138 in several known ways. For example, cap 131 may be directly welded to top face 138. Or, for example, cap 131 may screw onto top end 138 via threads on example retention assembly 122*a* and/or within individual bores 135. Although cap 131 is shown sized to cover a single bore 135, it is understood that cap may cover several or all bores 135, so as to seal irradiation targets 130 in multiple bores 135. For example, cap 131 may be annular and seal all bores 135 radially positioned in example retention assembly 122*a* but leave a middle bore 135 or hole 136 unsealed. In any of these attachments, cap 131 may retain irradiation targets 130 within a bore 135 and allow easy removal of cap 131 for containment and harvesting of desired solid, liquid, or gaseous radioisotopes and daughter products from irradiation targets 130.

As shown in FIG. 7, first example embodiment irradiation target retention assembly 122*a* may further include a hole 136 extending through assembly 122*a*. Hole 136 may be sized to capture a wire 124 (FIG. 4) and permit example retention assembly 122*a* to slide on wire 124. Similarly, hole 136 may be threaded or have other internal configurations that permit assembly 122*a* to join to and/or be moved along cable 100 (FIG. 2). In this way, one or more retention assemblies 122*a* may be placed in a delivery system, such as the ones illustrated in FIGS. 2-6, and successfully delivered in an instrumentation tube 50 in order to be irradiated.

Figure 8:
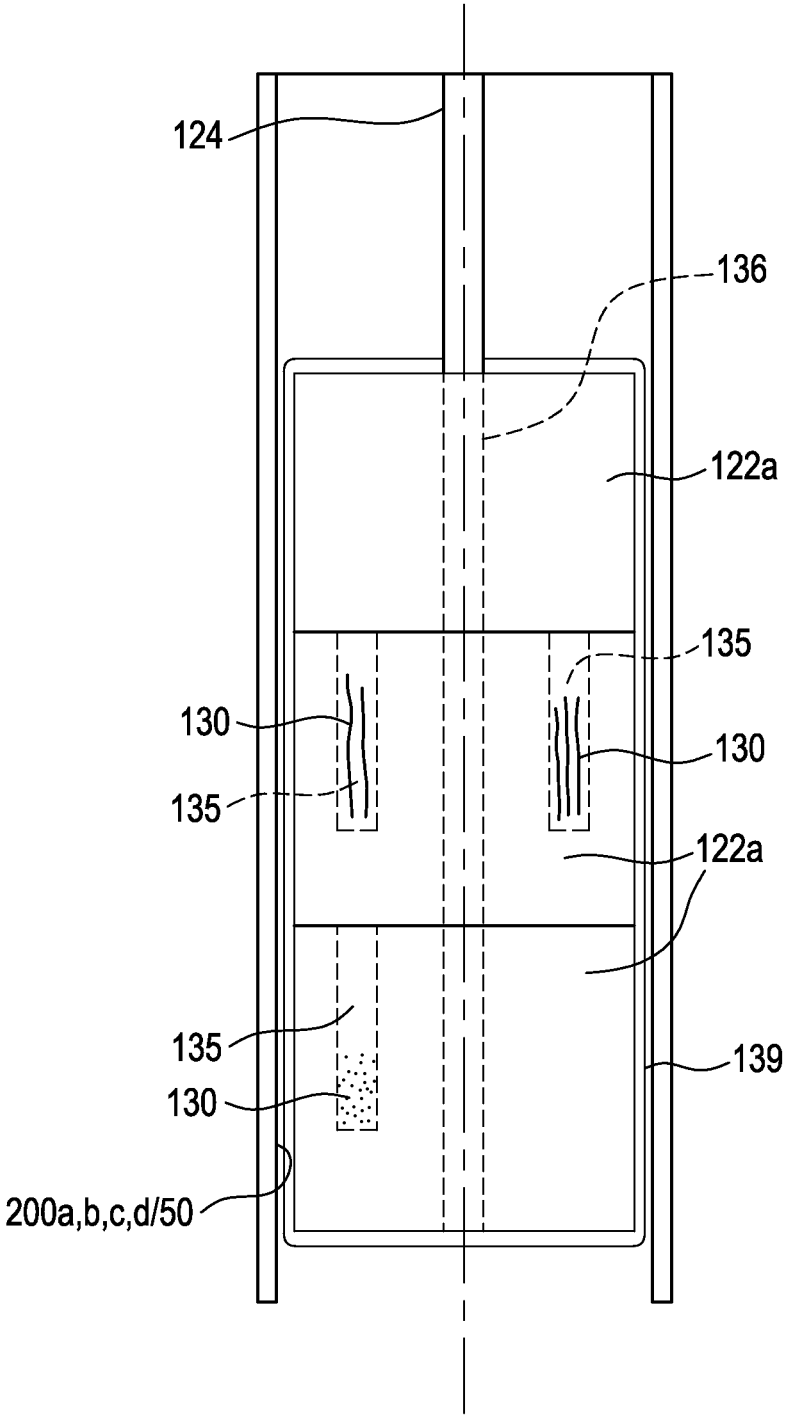
FIG. 8 is an illustration of several example embodiment irradiation target retention assemblies within an example embodiment delivery system.

FIG. 8 is an illustration of multiple example embodiment irradiation target retention assemblies 122*a* that may be used in combination. As shown in FIG. 8, several assemblies 122*a* may be serially placed on a wire 124 or other attaching mechanism to a delivery system. Example assemblies 122*a* may be tightly stacked with other example assemblies 122*a* on wire 124. A flexible adhesive tape 139 may further flexibly hold example assemblies 122*a* together. The flexible adhesive tape 139 may permit some relative movement of example retention assemblies 122*a* for bends in tubing 200*a, b, c, d*. Further, example retention assemblies 122*a* may have a length that permits passage through bends in tubing 200*a, b, c, d*, without becoming frictionally stuck in the tubing.

If a stack of example embodiment assemblies 122*a* are substantially flush against one another on cable 124, because bores 135 may not pass entirely through example assemblies 122*a*, the bottom surface of each assembly may be largely flat so as to facilitate a containing seal against another example assembly 122*a* stacked immediately below. In this way, irradiation targets 130 may be contained within bores 135 with or without an additional cap 131.

Figure 9:
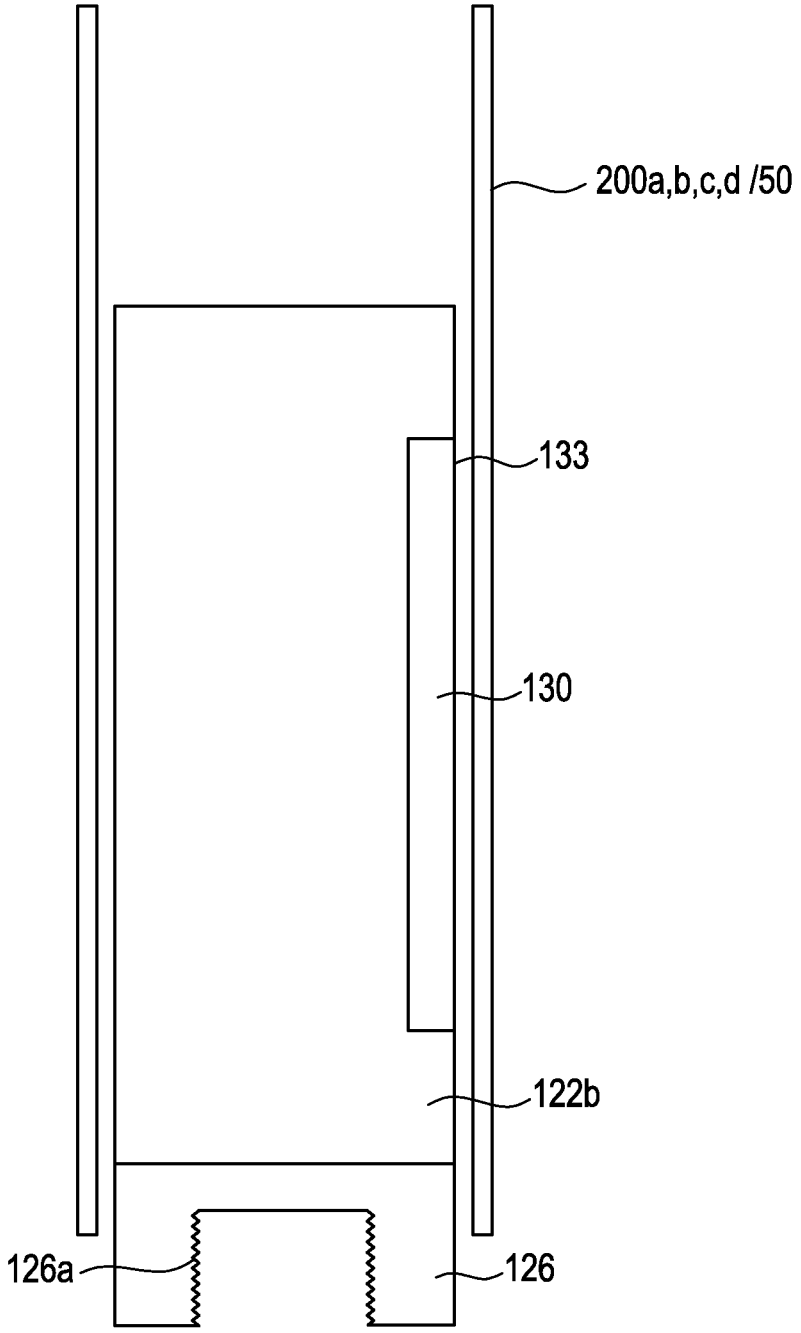
FIG. 9 is an illustration of a second example embodiment irradiation target retention assembly.

FIG. 9 is an illustration of a second example embodiment irradiation retention assembly 122*b*. As shown in FIG. 9, example embodiment irradiation target assembly 122*b* may be a generally hollow, sealed tube containing one or more irradiation targets 130. Irradiation targets 130 may additionally be sealed in a containment device within example assembly 122*b* so as to provide an additional level of containment and/or separate different types of targets and produced daughter produces. Irradiation targets 130 may be attached to a sidewall 133 of example assembly 122*b* in order to hold irradiation target 130 in place. Any type of known fastening/joining device may be used to join irradiation target 130 to sidewall 133.

Example embodiment irradiation target retention assembly 122*b* has dimensions that enable it to be inserted into instrumentation tubes 50 (FIG. 1) used in conventional nuclear reactors and/or through any tubing 200*a,b,c,d* used in delivery systems. For example, irradiation target retention assembly 122*b* may have a maximum outer diameter of an inch or less. Although irradiation target retention assembly 122*b* is shown as cylindrical, a variety of properly-dimensioned shapes, including hexahedrons, cones, and/or prismatic shapes may be used for irradiation target retention assembly 122*b*. Similarly, irradiation target retention assembly 122*b* may have a length that permits it to pass through any bends in tubing 200*a,b,c,d*, without becoming stuck.

Example embodiment irradiation target retention assembly 122*b* may be fabricated of a material that is configured to retain its structural integrity when exposed to flux encountered in an operating nuclear reactor. For example, example assembly 122*b* may be fabricated of aluminum, silicon, stainless steel, etc. Alternately, example embodiment irradiation target retention assembly 122*b* may be fabricated from a flexible material that permits some bending/deformation through bends in tubing 200*a,b,c,d*, including, for example, a high-temperature plastic. Still alternately, example embodiment irradiation target retention assembly 122*b* may be fabricated from an irradiation target material itself.

Example embodiment irradiation target retention assembly 122*b* may further include a first endcap 126 configured to join the assembly 122*b* to driving portion 110 of cable 100 (FIG. 3). For example, first endcap 126 may be threaded with internal threads 126*a* to join to an opposing-threaded end connector 113 of cable 100. In this way, example embodiment irradiation target retention assembly 122*b* may join to the example delivery system described in FIG. 3 and be delivered into an instrumentation tube 50 for irradiation in an operating nuclear reactor.

Example embodiments of irradiation target retention assemblies 122 may permit several different types and phases of irradiation targets 130 to be placed in each assembly 122. Because several example assemblies 122*a,b* may be placed at precise axial levels within an instrumentation tube 50, it may be possible to provide a more exact amount/type of irradiation target 130 at a particular axial level within instrumentation tube 50. Because the axial flux profile may be known in the operating reactor, this may provide for more precise generation and measurement of useful radioisotopes in irradiation targets 130 placed within example embodiment irradiation target retention assemblies. Example embodiment irradiation target retention assembly being described, example irradiation targets useable therein are described below.

Example Irradiation Targets

An irradiation target is a target that is irradiated for the purpose of generating radioisotopes. Accordingly, sensors, which may be irradiated by a nuclear reactor and which may generate radioisotopes, do not fall within the scope of term target as used herein since their purpose is to detect the state of the reactor rather than to generate radioisotopes.

Several different radioisotopes may be generated in example embodiments and example methods. Example embodiments and example methods may have a particular advantage in that they permit generation and harvesting of short-term radioisotopes in a relatively fast timescale compared to the half-lives of the produced radioisotopes, without shutting down a commercial reactor, a potentially costly process, and without hazardous and lengthy isotopic and/or chemical extraction processes. Although short-term radioisotopes having diagnostic and/or therapeutic applications are producible with example assemblies and methods, radioisotopes having industrial applications and/or long-lived half-lives may also be generated. Further, irradiation targets 130 may be chosen based on their relatively smaller neutron cross-section, so as to not interfere substantially with the nuclear chain reaction occurring in an operating commercial nuclear reactor core.

For example, it is known that Molybdenum-98 may be converted into Molybdenum-99, having a half-life of approximately 2.7 days when exposed to a particular amount of a neutron flux. In turn, Molybdenum-99 decays to Technetium-99m having a half-life of approximately 6 hours. Technetium-99m has several specialized medical uses, including medical imaging and cancer diagnosis, and a short-term half-life. Using irradiation targets 130 fabricated from Molybdnenum-98 and exposed to a neutron flux in an operating reactor based on the size of irradiation target 130, Molybdenum-99 and/or Technetium-99m may be generated and harvested in example embodiment assemblies and methods by determining the mass of the irradiation target containing Mo-98, the axial position of the target in the operational nuclear core, the axial profile of the operational nuclear core, and the amount of time of exposure of the irradiation target.

Table 1 below lists several short-term radioisotopes that may be generated in example methods using an appropriate irradiation target 130. The longest half-life of the listed short-term radioisotopes may be approximately 75 days. Given that reactor shutdown and spent fuel extraction may occur as infrequently as two years, with radioisotope extraction and harvesting from fuel requiring significant process and cool-down times, the radioisotopes listed below may not be viably produced and harvested from conventional spent nuclear fuel.

TABLE 1

List of potential radioisotopes produced

| Parent Material | Radioisotope Produced | Half-Life (approx) | Potential Use |
|---|---|---|---|
| Molybdenum-98 | Molybdenum-99 | 2.7 days | Imaging of cancer & poorly permeated organs |
| Chromium-50 | Chromium-51 | 28 days | Label blood cells and gastro-intestinal disorders |
| Copper-63 | Copper-64 | 13 hours | Study of Wilson's & Menke's diseases |
| Dysprosium-164 | Dysprosium-165 | 2 hours | Synovectomy treatment of arthritis |
| Erbium-168 | Erbium-169 | 9.4 days | Relief of arthritis pain |
| Holmium-165 | Holmium-166 | 27 hours | Hepatic cancer and tumor treatment |
| Iodide-130 | Iodine-131 | 8 days | Thyroid cancer and use in beta therapy |
| Iridium-191 | Iridium-192 | 74 days | Internal radiotherapy cancer treatment |
| Iron-58 | Iron-59 | 46 days | Study of iron metabolism and splenaic disorders |
| Lutetium-176 | Lutetium-177 | 6.7 days | Imagine and treatment of endocrine tumors |
| Palladium-102 | Palladium-103 | 17 days | Brachytherapy for prostate cancer |
| Phosphorus-31 | Phosphorous-32 | 14 days | Polycythemia vera treatment |
| Potassium-41 | Potassium-42 | 12 hours | Study of coronary blood flow |
| Rhenium-185 | Rhenium-186 | 3.7 days | Bone cancer therapy |
| Samarium-152 | Samarium-153 | 46 hours | Pain relief for secondary cancers |
| Selenium-74 | Selenium-75 | 120 days | Study of digestive enzymes |
| Sodium-23 | Sodium-24 | 15 hours | Study of electrolytes |
| Strontium-88 | Strontium-89 | 51 days | Pain relief for prostate and bone cancer |
| Ytterbium-168 | Ytterbium-169 | 32 days | Study of cerebrospinal fluid |

TABLE 1-continued

| List of potential radioisotopes produced | | | |
|---|---|---|---|
| Parent Material | Radioisotope Produced | Half-Life (approx) | Potential Use |
| Ytterbium-176 | Ytterbium-177 | 1.9 hours | Used to produce Lu-177 |
| Yttrium-89 | Yttrium-90 | 64 hours | Cancer brachytherapy |

Table 1 is not a complete list of radioisotopes that may be produced in example embodiments and example methods but rather is illustrative of some radioisotopes useable with medical therapies including cancer treatment. With proper target selection, almost any radioisotope may be produced and harvested for use through example embodiments and methods.

Example embodiments thus being described, it will be appreciated by one skilled in the art that example embodiments may be varied through routine experimentation and without further inventive activity. Variations are not to be regarded as departure from the spirit and scope of the exemplary embodiments, and all such modifications as would be obvious to one skilled in the art are intended to be included within the scope of the following claims.

What is claimed is:

1. A method of producing isotopes in a nuclear reactor with an irradiation target retention system, the method comprising:

inserting at least one irradiation target into an irradiation target retention assembly, the irradiation target configured to substantially convert to a desired radioisotope when exposed to a neutron flux in the operating nuclear reactor rigidly affixing the irradiation target retention assembly to a cable of a delivery system;

driving the irradiation target retention assembly and the cable into tubing of the delivery system using a drive mechanism, the tubing being connected to an instrumentation tube of the nuclear reactor;

inserting the irradiation target retention assembly on the cable into the instrumentation tube using the drive mechanism;

irradiating the at least one irradiation target;

removing the irradiation target retention assembly on the cable from the nuclear reactor using the drive mechanism; and harvesting the desired radioisotope from the irradiation target retention assembly.

2. The method of claim 1, wherein the inserting the irradiation target retention assembly on the cable into the instrumentation tube further includes driving the irradiation target retention assembly and the cable through a first guide, the first guide being located between the drive mechanism an the instrumentation tube.

3. The method of claim 2, wherein the inserting the irradiation target retention assembly on the cable into the instrumentation tube further includes driving the irradiation target retention assembly and the cable through a second guide, the second guide being located between the first guide and the instrumentation tube.

4. The method of claim 1, wherein the at least one irradiation target retention assembly includes at least one bore configured to contain the at least one irradiation target.

5. The method of claim 4, wherein the at least one irradiation target retention assembly includes a cap configured to attach to an end of the irradiation target retention assembly to retain the irradiation target within the at least one bore.

6. The method of claim 1, wherein the irradiation target is at least one of Molybdenum-98, Chromium-50, Copper-63, Dysprosium-164, Erbium-168, Holmium-165, Iron-58, Lutetium-176, Palladium-102, Phosphurus-31, Potassium-41, Rhenium-185, Samarium-152, Selenium-74, Sodium-23, Strontium-88, Ytterbium-168, Ytterbium-176, Ytterium-89, Iridium-191, and Cobalt-59.

7. The method of claim 1, wherein the irradiation target retention assembly defines a hole passing through the irradiation target retention assembly, the hole having a diameter configured to secure the irradiation target retention assembly to a wire of the delivery system.

8. The method of claim 1, wherein the irradiation target retention assembly is fabricated from at least one of a zirconium alloy, stainless steel, aluminum, nickel alloy, silicon, graphite, and Inconel.

9. The method of claim 1, wherein the irradiation target retention assembly includes, a hollow, sealed tube containing the at least one irradiation target.

10. The method of claim 9, further comprising:

an endcap configured to join the irradiation target retention assembly to a cable of the delivery system.

* * * * *